US007717108B2

(12) United States Patent
Ball

(10) Patent No.: US 7,717,108 B2
(45) Date of Patent: May 18, 2010

(54) HINGED HEADBRACE FOR FRONT-MOUNTED SWIMMING SNORKEL

(76) Inventor: Edwin C. Ball, 8551 - 113B Street, Delta, BC (CA) V4C 5G3

( * ) Notice: Subject to any disclaimer, the term of this patent is extended or adjusted under 35 U.S.C. 154(b) by 957 days.

(21) Appl. No.: 11/422,582

(22) Filed: Jun. 6, 2006

(65) Prior Publication Data

US 2007/0199565 A1 Aug. 30, 2007

Related U.S. Application Data

(63) Continuation-in-part of application No. PCT/CA2006/002912, filed on Feb. 24, 2006.

(51) Int. Cl.
*B63C 11/16* (2006.01)

(52) U.S. Cl. ..... 128/201.11; 128/201.26; 128/201.27

(58) Field of Classification Search ..... 128/200.29, 128/201.11, 201.22, 201.23, 201.24, 201.26, 128/201.27, 206.29, 204.27, 207.18; 403/329, 403/330; 248/291.1; 405/186, 187
See application file for complete search history.

(56) References Cited

U.S. PATENT DOCUMENTS

| | | | | |
|---|---|---|---|---|
| 2,753,865 | A | 7/1956 | Van der Kogel | |
| 3,860,042 | A | 1/1975 | Green | |
| 4,907,582 | A * | 3/1990 | Meyerrose | 128/201.11 |
| 5,117,817 | A | 6/1992 | Lin | |
| 5,487,379 | A | 1/1996 | Koshiishi | |
| 5,664,558 | A | 9/1997 | Wagner | |
| 5,697,362 | A | 12/1997 | Albrecht | |
| D406,333 | S | 3/1999 | Garraffa | |
| 6,085,744 | A | 7/2000 | Hermansen et al. | |
| 6,295,983 | B1 * | 10/2001 | Semeia | 128/201.11 |
| 6,302,102 | B1 | 10/2001 | Giroux et al. | |
| 6,318,363 | B1 | 11/2001 | Monnich | |
| 6,668,822 | B2 | 12/2003 | Monnich | |
| 6,736,136 | B2 * | 5/2004 | Chen-Lieh | 128/201.11 |
| 7,234,461 | B2 * | 6/2007 | Mix | 128/201.11 |
| 2004/0079365 | A1 * | 4/2004 | Sato | 128/201.11 |
| 2005/0034729 | A1 * | 2/2005 | Dombrowski | 128/207.14 |

FOREIGN PATENT DOCUMENTS

| | | | |
|---|---|---|---|
| CA | 1057452 | A | 7/1979 |
| CA | 2073175 | A1 | 7/1991 |
| WO | WO 2004/110857 | A | 12/2004 |

OTHER PUBLICATIONS

International Search Report for PCT/CA200600291, International Searching Authority, May 11, 2006, pp. 1-3.
International Preliminary Report on Patentability for PCT/CA2006/001584, International Preliminary Examining Authority Aug. 2, 2007, pp. 1-3.

* cited by examiner

*Primary Examiner*—Quang D Thanh
(74) *Attorney, Agent, or Firm*—Oyen Wiggs Green & Mutala LLP

(57) ABSTRACT

A front-mounted swimming snorkel has a forehead brace which pivots about an axis perpendicular to the snorkel tube to adapt to different swimmers' heads.

2 Claims, 12 Drawing Sheets

HINGED HEADBRACE FOR FRONT-MOUNTED SWIMMING SNORKEL

CROSS-REFERENCE TO RELATED APPLICATIONS

This application is a continuation-in-part of International application no. PCT/CA2006/02912, filed 24 Feb. 2006 designating the United States, which is pending.

TECHNICAL FIELD

The invention relates to swimming aids and more particularly to snorkels for use as recreational and fitness training swimming aids.

BACKGROUND

Swimmers in a swimming pool or an open body of water often use the front crawl stroke, where in order to breathe, a swimmer must either lift his or her head or rotate it to one side, which also rotates and disrupts the body alignment. While diving snorkels have long been used to permit divers to breathe when near the surface of the water without lifting their heads from the water, snorkels have only recently been developed to allow swimmers to breathe while using the front crawl or other strokes without lifting or turning their heads.

The present inventor has disclosed and claimed a front-mounted snorkel in International application no. PCT/CA2006/02912, filed 24 Feb. 2006, and issued U.S. Pat. No. 7,047,965 issued May 23, 2006, which are incorporated herein by reference. A front-mounted swimmer's snorkel is also disclosed in U.S. Design Pat. No. Des 406,333 of Finis, Inc. It has a snorkel tube positioned in front of the user's forehead and secured by a head-brace, which extends above the water surface and has at its lower end a mouthpiece held in the user's mouth and a water purge valve. A problem with the Finis snorkel is that the head brace is at a fixed angle relative to the mouthpiece tube, so it does not accommodate swimmers with differently shaped foreheads.

There is a need therefore for a front-mounted swimming snorkel which adapts to different swimmers with varying head sizes and shapes.

SUMMARY OF INVENTION

The invention provides a swimming snorkel for use by a swimmer while swimming on or adjacent the surface of the water comprising means for releasably securing the snorkel to the head of the swimmer, whereby the mouth-piece of the snorkel is held in the mouth of the swimmer and the upper ends of the snorkel tube extends above the surface of the water when the head and body of the swimmer are on or adjacent to the surface of the water, wherein the means for securing the snorkel tube to the head of the swimmer is hingedly connected to the snorkel tube by hinge means pivotable about an axis perpendicular to said hollow airway.

BRIEF DESCRIPTION OF DRAWINGS

In drawings which describe preferred embodiments of the invention:

FIG. 4A is a lower end view of the valve assembly shown in FIG. 4.

FIG. 4B is a side view of the valve assembly shown in FIG. 4.

FIGS. 4C, 4D and 4E are cross-sectional views of the breathing tube shown in FIG. 4.

FIG. 4F is an end view, partially in cross-section, of the mouthpiece and hollow chamber shown in FIG. 1.

FIG. 4H is a cross-section of the valve assembly shown in FIG. 4 with the butterfly valve shown in the closed position.

DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

Figure 1:
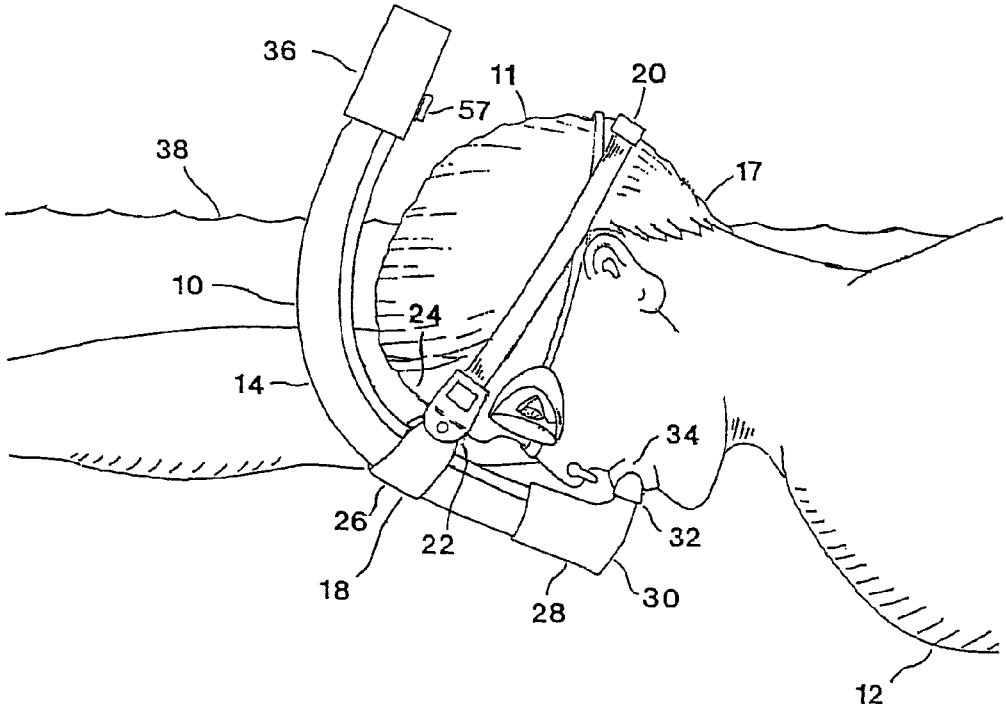
FIG. 1 is a side elevation view of a first embodiment of the invention in use by a swimmer.
Figure 2:
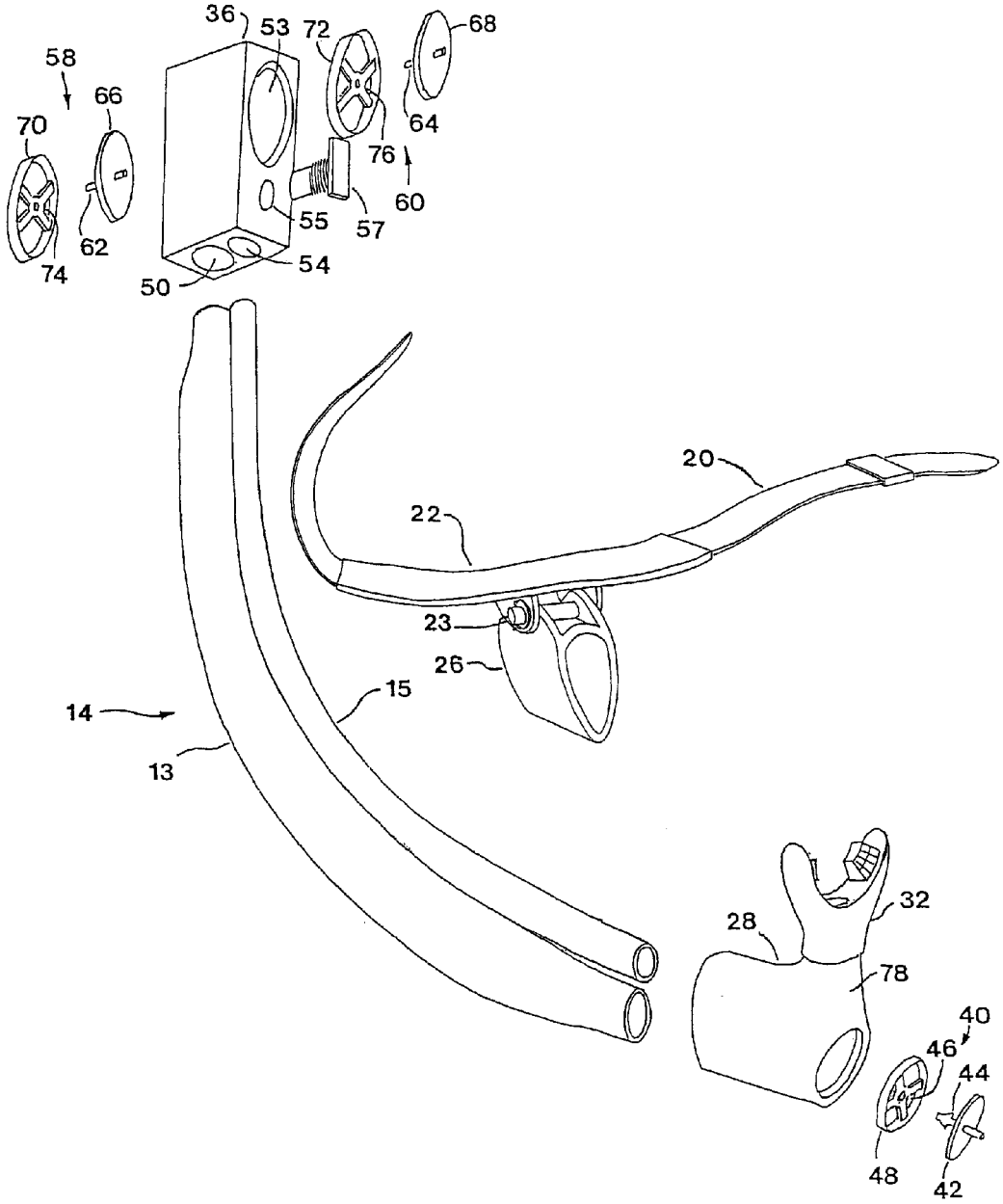
FIG. 2 is an exploded perspective view of the embodiment of the invention shown in FIG. 1.

With reference to FIGS. 1 and 2, a swimming snorkel 10 according to the invention is in use by a swimmer 12. The snorkel 10 has a curved breathing tube 14 which is secured to the head 11 of the swimmer by a brace assembly 18 which comprises an adjustable, flexible rubber strap 20, a forehead brace 22 which is secured to the strap 20 and bears against the swimmer's forehead 24, and is hingedly connected to an adjustable tube-mounting element 26 secured to forehead brace 22 which slidingly receives the breathing tube 14. Adjustable tube mounting element 26 is slidable with a friction fit on breathing tube 14 and is connected by hinge rod 23 with forehead brace 22 to form a hinge that allows rotation of mounting element 26.

Tube 14 is connected to hollow chamber 28, which has water purge exit passage 30 (FIG. 2) and is connected to mouthpiece 32 which is held in the mouth 34 of the swimmer. Tube 14, with a valve assembly 36 and an adjustable threaded butterfly valve 57 at its upper end, curves through an angle of approximately 90 degrees from chamber 28 to valve assembly 36 and is sufficiently long, generally about eighteen inches, so that the valve assembly 36 extends above the water line 38 when the swimmer's head 11 and body 17 are horizontally oriented during swimming.

Figure 3:
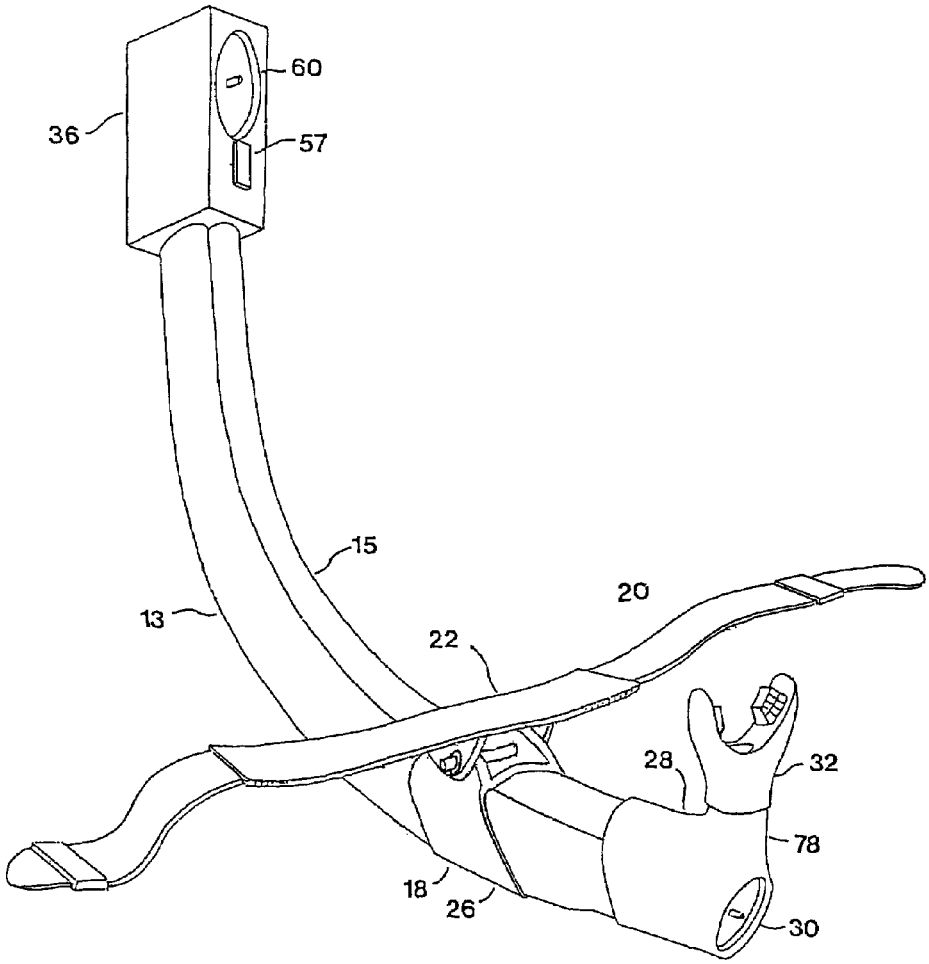
FIG. 3 is a perspective view of a first embodiment of the invention.
Figure 4:
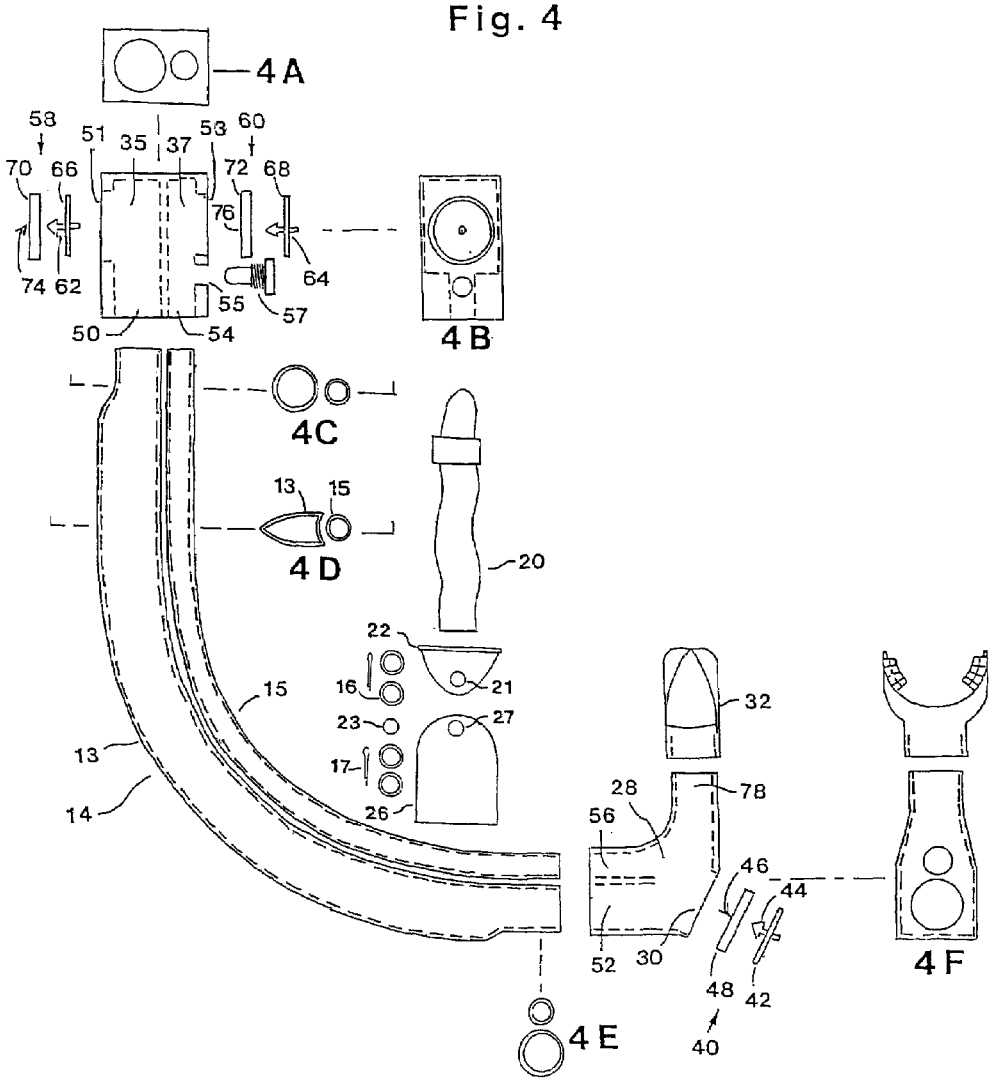
FIG. 4 is an exploded side view of the embodiment of the invention shown in FIG. 1.

With reference to FIG. 2 through 4, tube 14 comprises hollow intake tube 13 and exhaust tube 15. Valve assembly 36 is divided into intake chamber 35 and exhaust chamber 37. Intake chamber 35 communicates with intake passage 51 and intake tube port 50. Exhaust chamber 37 communicates with exhaust passage 53 and exhaust tube port 54. Threaded hole 55 extends through the wall of exhaust chamber 37 and receives threaded butterfly valve 57 to form a compression seal along the surface of the threads that does not allow the entry of air or water. Intake tube port 50 and exhaust tube port 54 receive the upper ends of intake tube 13 and exhaust tube 15. Intake passage 51 and exhaust passage 53 have one-way valves 58, 60 respectively which comprise flexible silicone valve diaphragms 66, 68 having central stems 62, 64 which are secured in central apertures 74, 76 of valve seats 70, 72. More than one one-way valve may be provided for either or both the intake or the exhaust passages.

Hollow chamber 28 communicates with mouthpiece passage 78, purge exit passage 30, intake tube port 52 and exhaust tube port 56. Intake tube port 52 and exhaust tube port 56 receive the lower ends of intake tube 13 and exhaust tube 15. Water purge exit passage 30 is closed by a one-way valve 40 comprising a flexible silicone valve diaphragm 42 having a central stem 44 which is secured in a central aperture 46 of valve seat 48.

Figure 4G:
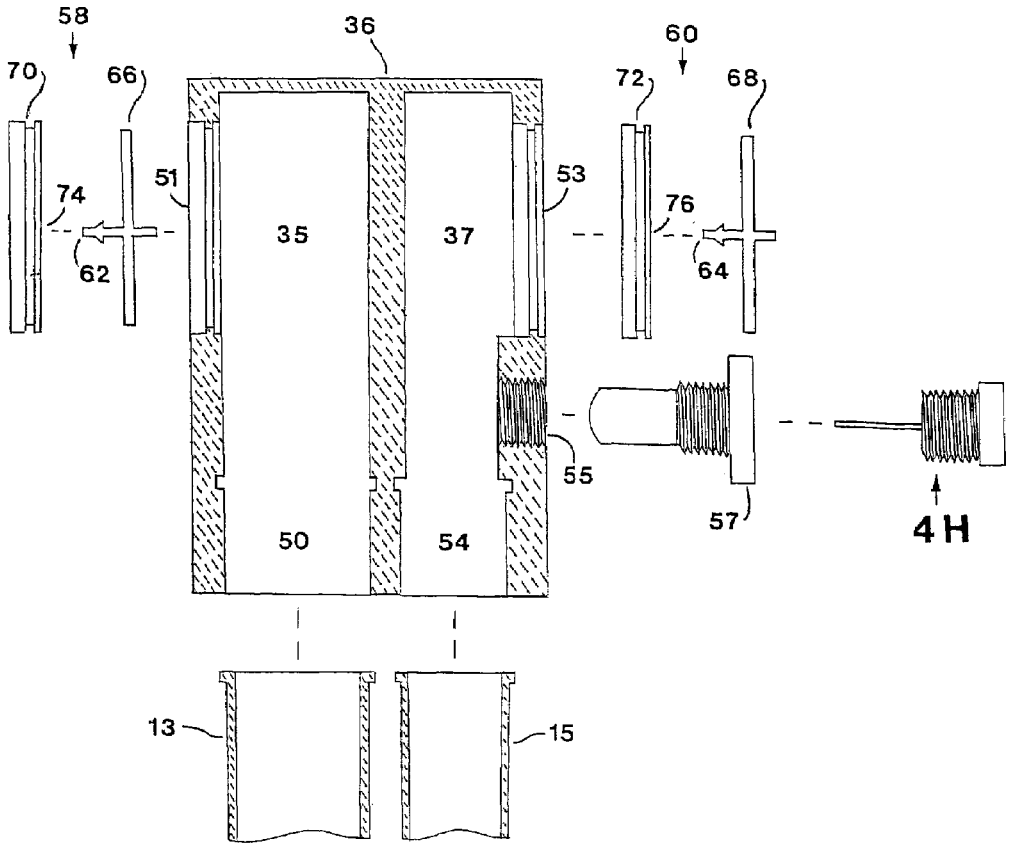
FIG. 4G is a detail cross-section view of the valve assembly shown in FIG. 4 with the butterfly valve shown in the open position.

As shown in cross-section in FIG. 4C, 4D and 4E, while the upper and lower ends of inlet tube 13 are preferably circular in cross-section, the rest of inlet tube 13 has an arrowhead or bullet-shaped cross-section to reduce the hydrodynamic drag while swimming for reduced resistance through the water. Other shapes may be used to accomplish the same result. However the intake tube 13 should have a minimum cross-sectional area of about 0.44 square inch (0.75 inch circular diameter), so that a minimum amount of force is needed to inhale. FIG. 4G shows the valve assembly 36, and FIG. 4H shows the threaded butterfly valve 57 in closed position.

Figure 4J:
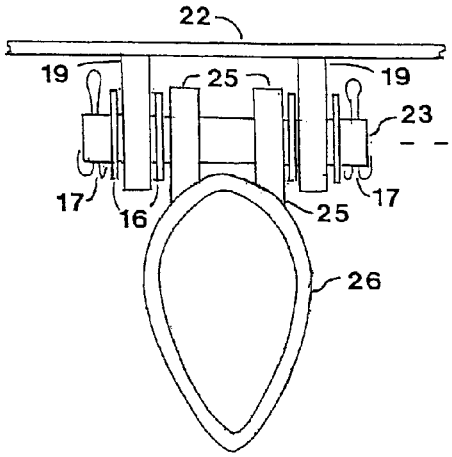
FIGS. 4J and 4K are detail views of the headbrace connection of the invention.
Figure 4K:
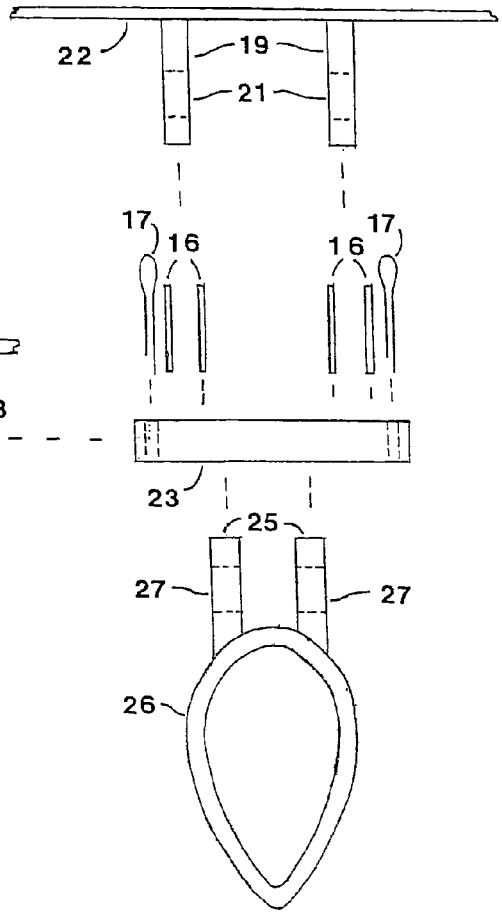
Figure 5:
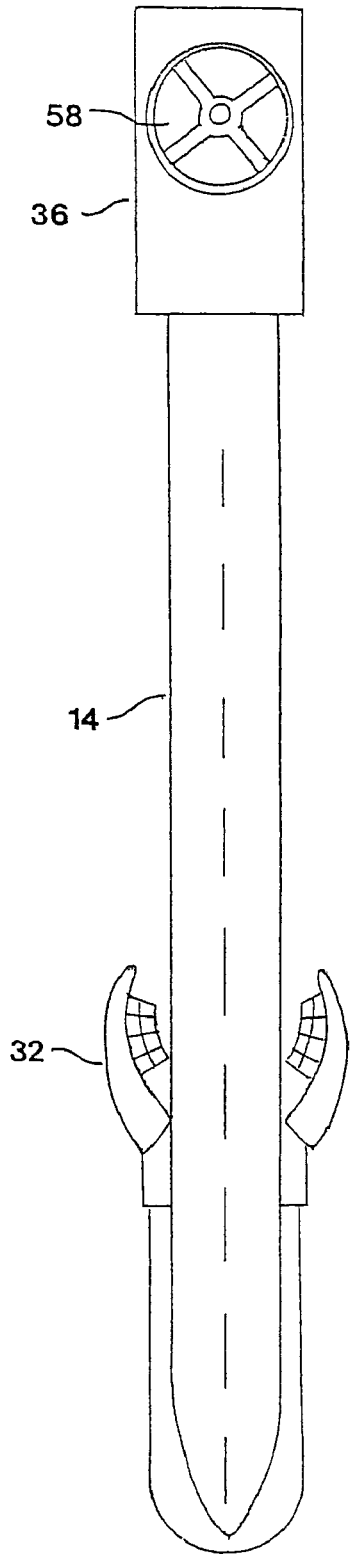
FIG. 5 is a front view of the snorkel shown in FIG. 3.
Figure 6:
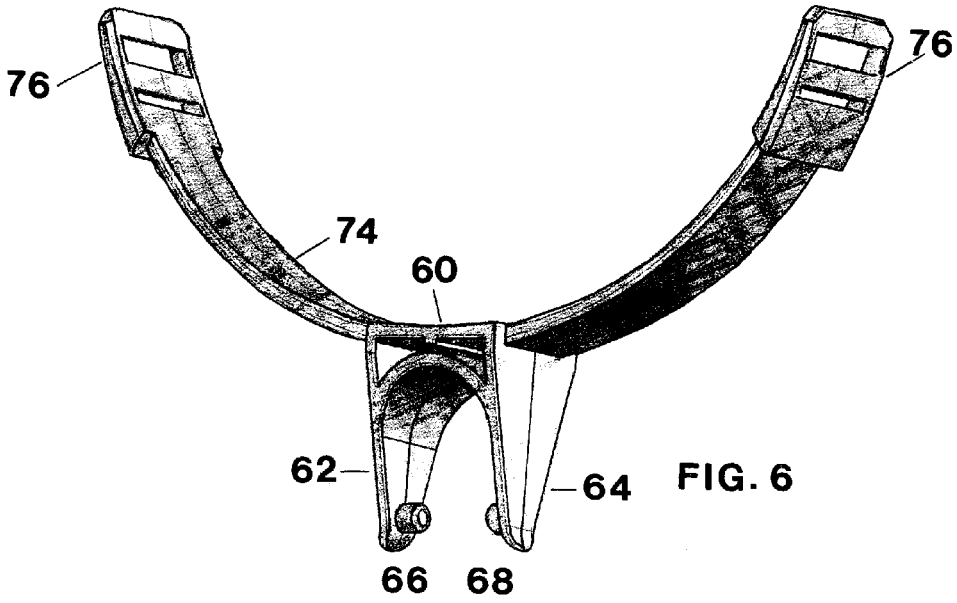
FIG. 6 is a perspective view of a second embodiment of the headbrace of the invention.
Figure 7:
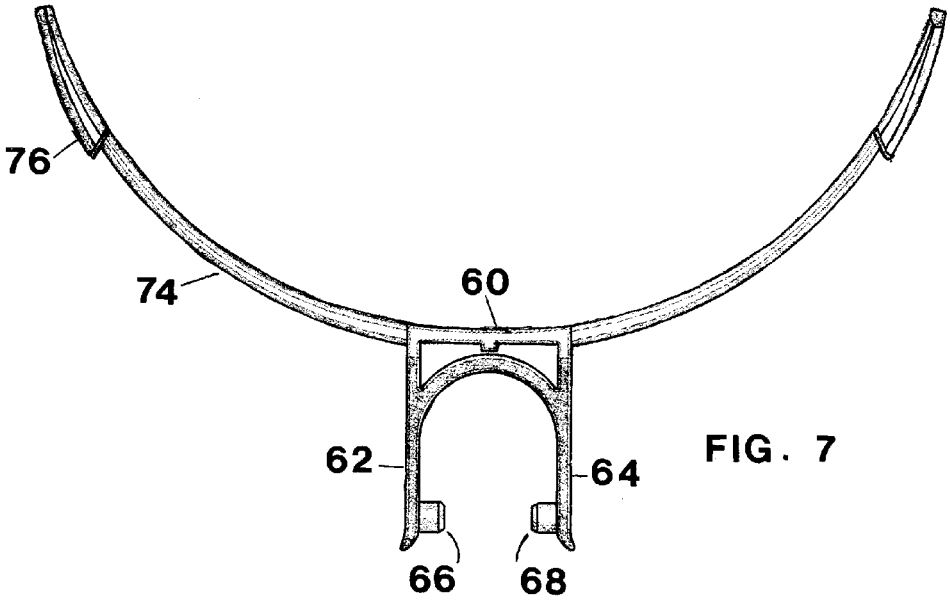
FIG. 7 is a front view of the embodiment of the headbrace shown in FIG. 6.
Figure 8:
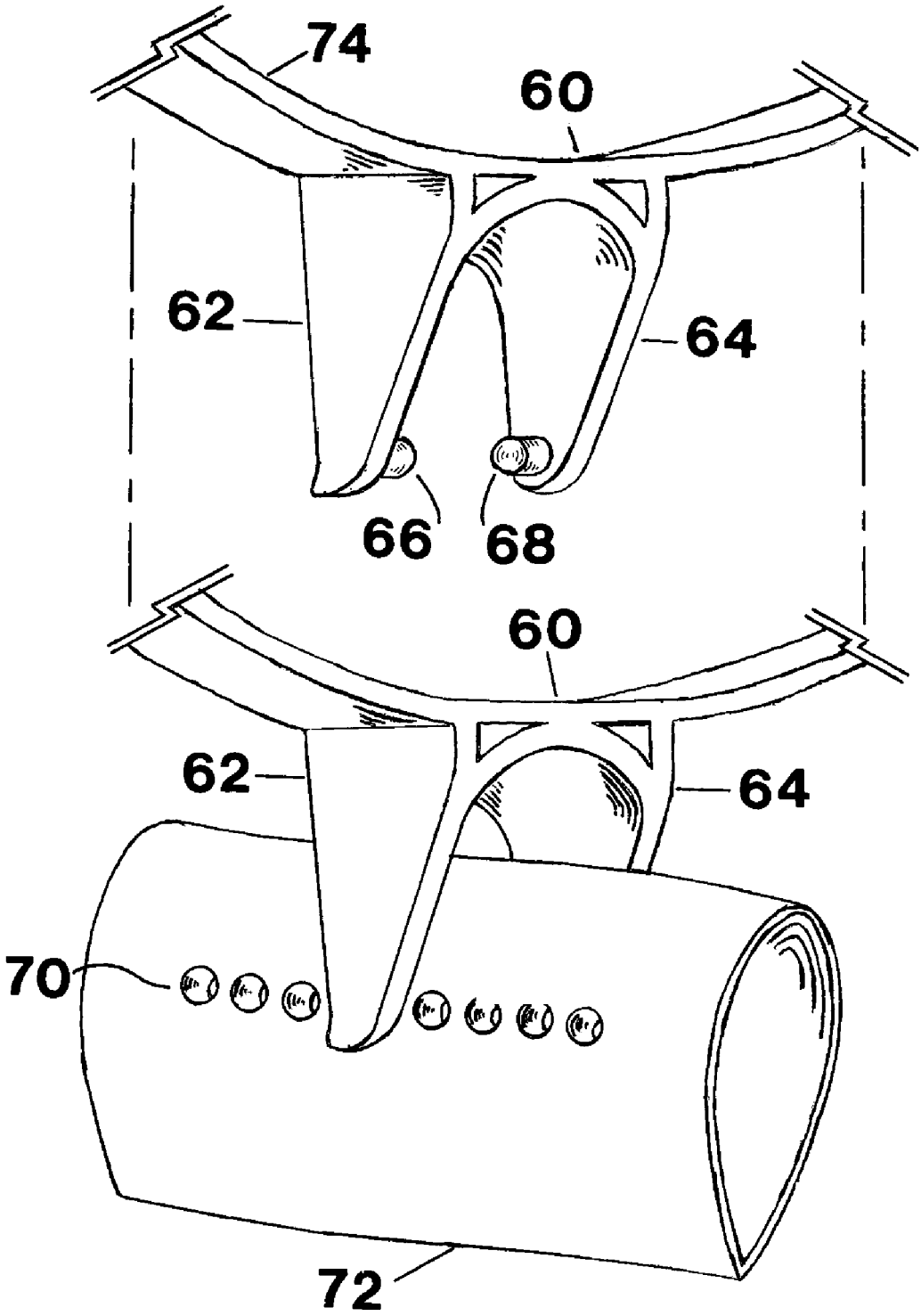
FIG. 8 is a detailed perspective view of the embodiment of the headbrace of the invention shown in FIG. 6 in place on the snorkel tube.
Figures 9, 10:
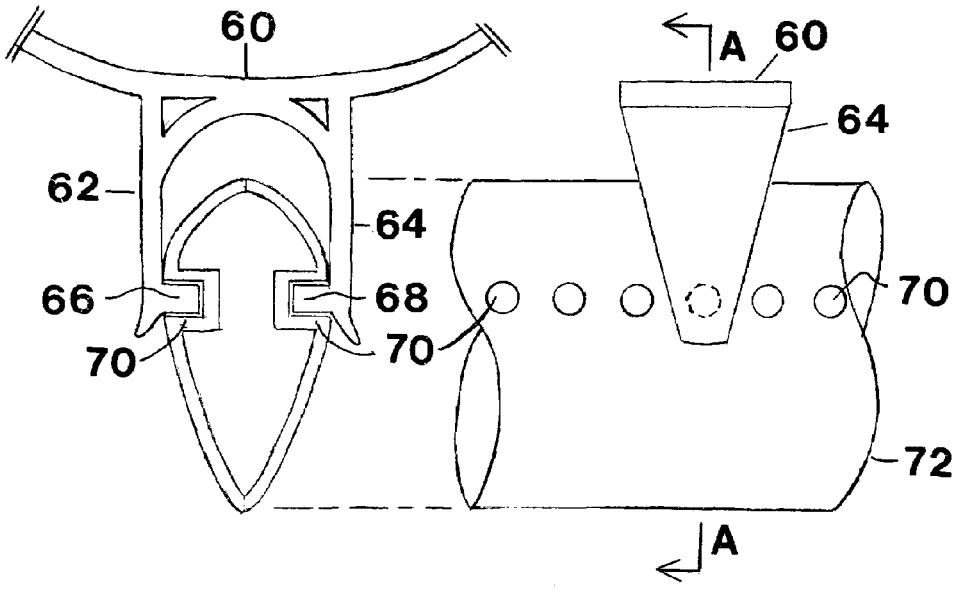
FIG. 9 is a side view of the embodiment of the headbrace of the invention shown in FIG. 8.
FIG. 10 is a cross-section taken along lines A-A of FIG. 9.
Figure 11:
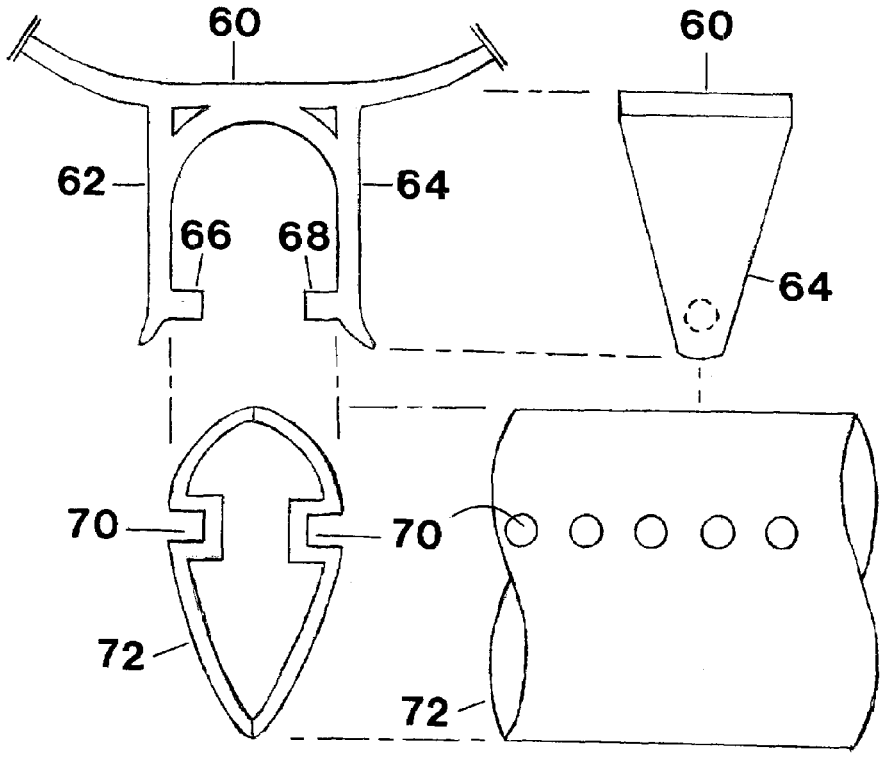
FIG. 11 is an exploded view of the embodiment shown in FIG. 9 and 10.
Figure 12:
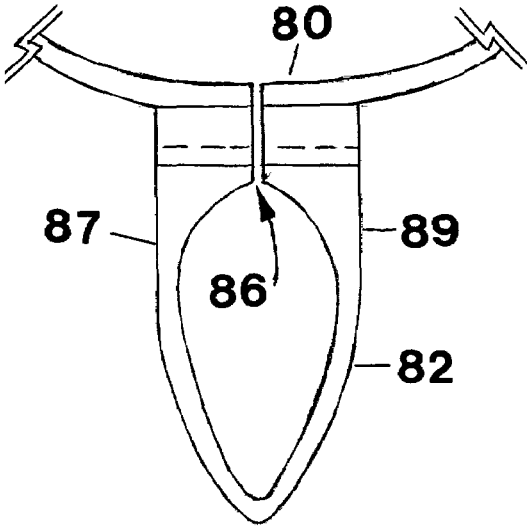
FIG. 12 is a front view of a third embodiment of the headbrace of the invention.

As shown in FIGS. 4J and 4K, adjustable tube mounting element 26 is connected to forehead brace 22 by hinge rod 23 which extends through holes 27 in extending arms 25 and holes 21 in extending arms 19 and is secured with washers 16 and cotter pins 17. The tube mounting element is thereby hinged on forehead brace 22 and moveable about the axis defined by hinge rod 23.

The adjustable tube-mounting element 26 is attached by a hinge to the forehead brace 22 to allow pivoting only about an axis perpendicular to the breathing tube 14 so that the entire forehead brace will make contact with the swimmer's forehead and press more firmly against the forehead to prevent the forehead brace from moving when the breathing tube 14 jogs or veers to one side in the water. The hinged forehead brace will thus fit snugly against the swimmer's forehead independent of the shape of the forehead.

A second embodiment of the forehead brace is shown in FIG. 6 through 11. In this embodiment, the forehead brace 60 has flexible arms 62, 64 on which are provided cylindrical hinge pins 66, 68. Hinge pins 66, 68 are rotatably received in cylindrical depressions 70 formed in the hollow snorkel tube 72. Cylindrical depressions 70 are formed in two parallel rows on opposite sides of snorkel tube 72 so that the position of brace 22 can be adjusted along the length of snorkel tube 72. The length and separation of the hinge pins 66, 68 is such that when the pins are received in depressions 70, the flexible arms 62, 64 are parallel and retain the pins 66, 68 in place, but when arms 62, 64 are flexed apart the pins 66, 68 can be removed from depressions 70. A strap 74 is secured to brace 60 having strap connectors 76 to which a strap around the head of the swimmer can be adjustably secured. Thus the brace 22 is able to pivot about the axis formed by pins 66, 68 and can be adjusted along the length of the snorkel tube.

Figure 13:
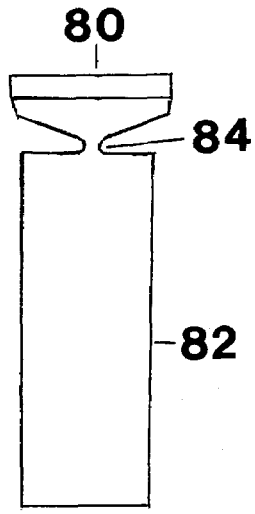
FIG. 13 is a side view of the embodiment shown in FIG. 12.
Figure 14:
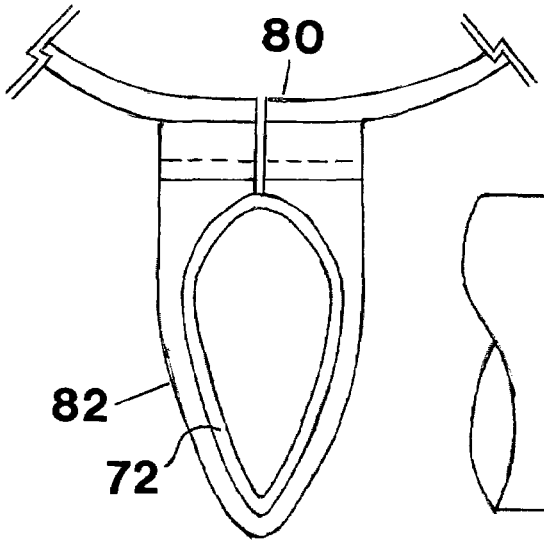
FIG. 14 is a front view of the embodiment of the invention shown in FIG. 12 in place on the snorkel tube.
Figure 15:
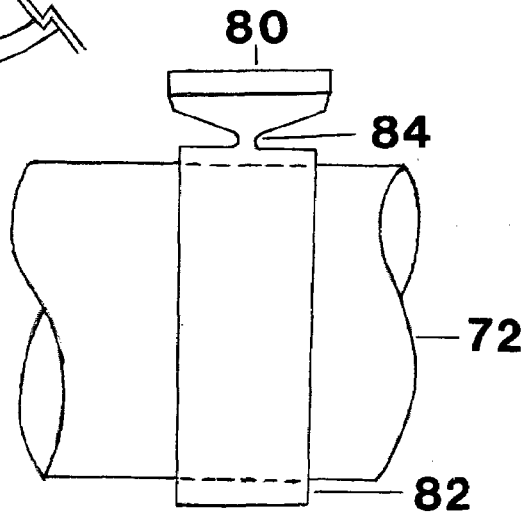
FIG. 15 is a side view of the embodiment of the invention shown in FIG. 12 in place on the snorkel tube.
Figure 16:
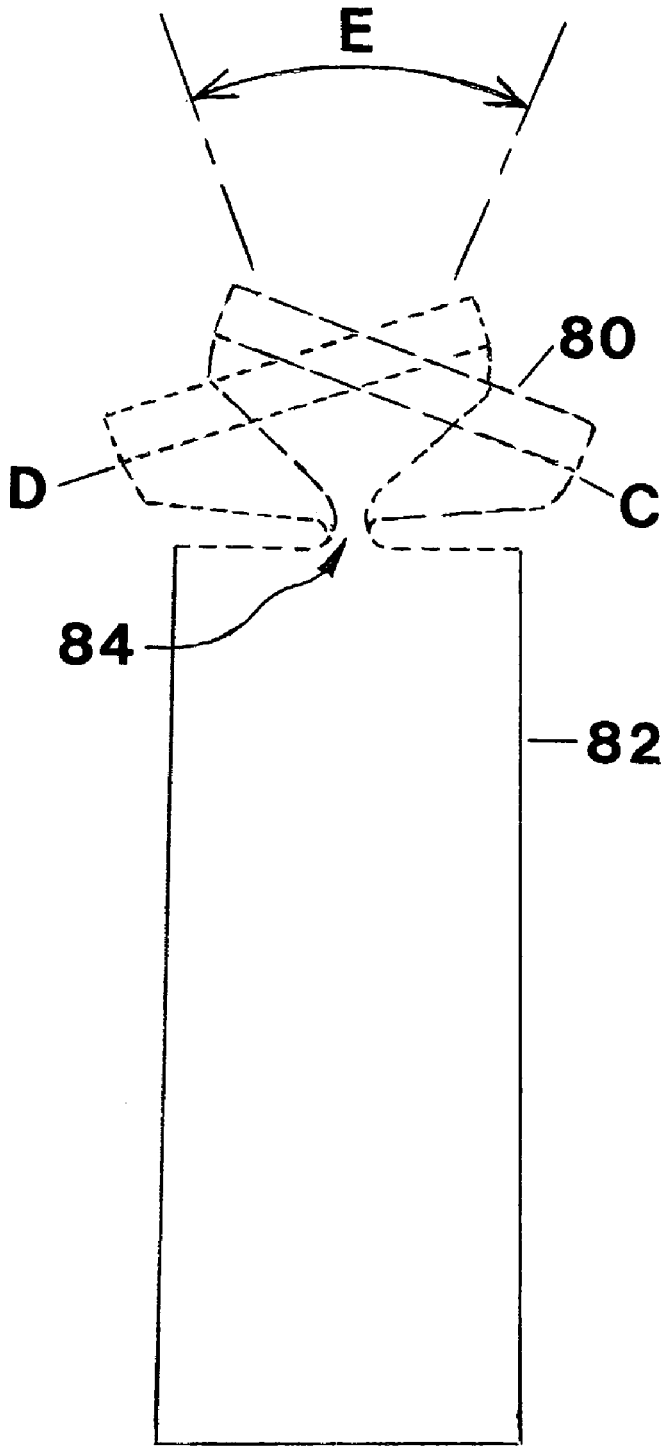
FIG. 16 is a schematic side view of the embodiment shown in FIG. 12 showing two positions of the headbrace in dotted outline.

A third embodiment of the forehead brace is shown in FIG. 12 through 16. In this embodiment, a flexible material between the head brace and the tube or the tube-mounting element allows pivoting about an axis perpendicular to the breathing tube. The forehead brace 80 is connected to a connecting sleeve 82 by a living hinge 84. Living hinge 84 is formed of a plastic material which returns to a rest configuration as shown in FIG. 13 when pressure is not applied to it, but when pressure is applied, living hinge 84 can pivot through angle E between the positions C and D shown in FIG. 16. A slit 86 in brace 80 allows the two halves 87, 89 of brace 80 to be separated to snap sleeve 82 around the snorkel tube 72 at the desired location. As in the other embodiments, a strap (not shown) is secured to brace 80 using strap connectors so that the strap around the head of the swimmer can be adjustably secured. Thus brace 80 is able to pivot in the direction of angle E and can be adjusted along the length of the snorkel tube.

As will be apparent to those skilled in the art in the light of the foregoing disclosure, many alterations and modifications are possible in the practice of this invention without departing from the spirit or scope thereof. The invention will usefully operate on snorkel tubes of differing cross-sectional shapes, such as oval, square, star, rectangular, round or other shapes as well as single or multiple tubes. Also whereas a single axis hinge has been disclosed to allow movement of the head brace about the axis defined by the hinge rod, other means for hingedly connecting the head brace to the tube or the tube-mounting element would also be suitable, such as providing a flexible material between the head brace and the tube or the tube-mounting element which allows pivoting about an axis perpendicular to the breathing tube. Accordingly, the scope of the invention is to be construed in accordance with the substance defined by the following claims.

What is claimed is:

1. A swimming snorkel for use by a swimmer while swimming on or adjacent the surface of the water comprising:

(a) a mouthpiece;

(b) an elongated hollow airway having upper and lower ends and communicating between said mouthpiece and air outside said snorkel; and c) means for releasably securing the snorkel to the head of the swimmer, whereby the mouthpiece is held in the mouth of the swimmer and the upper end of the hollow airway extends above the surface of the water when the head of the swimmer is on or adjacent to the surface of the water; and wherein the means for releasably securing said snorkel to the head of the swimmer is hingedly connected to said hollow airway by hinge means pivotable about an axis perpendicular to said hollow airway;

wherein said means for releasably securing said snorkel to the head of said swimmer comprises elongated strap means secured to a brace adapted to rest against the swimmer's forehead, said brace being hingedly connected to said hollow airway by said hinge means pivotable about an axis perpendicular to said hollow airway, wherein said hollow airway is provided with an array of pin-receiving depressions along a length of the airway, said hinge means comprising hinge pins pivotally received in said pin-receiving depressions, and wherein said hinge pins are mounted on spaced arms secured to said brace whereby the position of said brace is adjustable along said length.

2. The snorkel of claim 1 wherein said hinge means comprise hinge pins pivotally received in pin-receiving depressions formed in the surface of said hollow airway.

* * * * *